US007535328B2

(12) United States Patent
Kurasawa et al.

(10) Patent No.: US 7,535,328 B2
(45) Date of Patent: May 19, 2009

(54) ELECTROMAGNETIC SWITCH

(75) Inventors: Tadahiro Kurasawa, Chita-gun (JP); Shinji Usami, Okazaki (JP); Tomohiro Teramachi, Kariya (JP)

(73) Assignee: Denso Corporation, Kariya (JP)

( * ) Notice: Subject to any disclaimer, the term of this patent is extended or adjusted under 35 U.S.C. 154(b) by 150 days.

(21) Appl. No.: 11/708,603

(22) Filed: Feb. 21, 2007

(65) Prior Publication Data

US 2007/0194867 A1 Aug. 23, 2007

(30) Foreign Application Priority Data

Feb. 23, 2006 (JP) ..... 2006-047026
Jun. 30, 2006 (JP) ..... 2006-181362
Aug. 29, 2006 (JP) ..... 2006-231875

(51) Int. Cl.
*H01F 3/00* (2006.01)
*H01F 7/08* (2006.01)

(52) U.S. Cl. ..... 335/281; 335/126; 335/135; 335/180; 335/273; 335/297; 335/90; 335/104; 335/193; 335/277; 335/298; 335/105; 335/127; 335/128; 310/12; 310/14; 310/23; 310/34; 310/179; 310/193; 310/216; 310/258; 310/259

(58) Field of Classification Search ..... 335/126–132, 335/135, 180, 273, 281, 297–298, 90, 104–105, 335/193, 277; 310/12, 14, 23, 34, 179, 193, 310/216, 258–259

See application file for complete search history.

(56) References Cited

U.S. PATENT DOCUMENTS

| | | | | |
|---|---|---|---|---|
| 3,171,064 | A * | 2/1965 | Ruder | 335/297 |
| 3,207,960 | A * | 9/1965 | MacDougal | 335/297 |
| 4,044,322 | A * | 8/1977 | Brown et al. | 335/131 |
| 5,181,002 | A * | 1/1993 | Sugiyama | 335/131 |
| 6,281,770 | B1 | 8/2001 | Quentric | |
| 7,420,309 | B2 * | 9/2008 | Wakitani et al. | 310/216 |
| 2007/0013255 | A1 * | 1/2007 | Wakitani et al. | 310/216 |
| 2007/0188278 | A1 * | 8/2007 | Tsukada et al. | 335/132 |

FOREIGN PATENT DOCUMENTS

| | | |
|---|---|---|
| JP | A 5-126018 | 5/1993 |
| JP | A 2002-524826 | 8/2002 |

* cited by examiner

*Primary Examiner*—Lincoln Donovan
*Assistant Examiner*—Mohamad A Musleh
(74) *Attorney, Agent, or Firm*—Oliff & Berridge, PLC

(57) ABSTRACT

In an electromagnet switch, a stationary iron core is composed mainly of a base part and a disk part. The base part is faced to a plunger and the disk part is forcedly inserted and fixed to a boss part formed in the base part. The disk part is composed of a metal plate of ferromagnetic substance (iron plate) and another substance plate (made of resin or rubber and the like, for example,) of a smaller spring constant or a larger damping coefficient than that of the metal plate. The metal plate and another substance plate are laminated. Another substance plate absorbs or reduces the impact force when the plunger is electromagnetically attracted toward and collides with the base part. The propagation of a large impact noise or crashing sound is thereby suppressed, and as a result the impact noise can be reduced.

16 Claims, 7 Drawing Sheets

ELECTROMAGNETIC SWITCH

CROSS-REFERENCE TO RELATED APPLICATIONS

This application is related to and claims priority from Japanese Patent Applications No. 2006-47026, filed on Feb. 23, 2006, No. 2006-181362, filed on Jun. 30, 2006, and No. 2006-231875, filed on Aug. 29, 2006, the contents of which are hereby incorporated by reference.

BACKGROUND OF THE INVENTION

1. Field of the Invention

The present invention relates to an electromagnetic switch capable of turning on and turning off an electric contact mounted on an energized electric circuit of a starter motor.

2. Description of the Related Art

In order to satisfy recent demand of reducing the fuel consumption for saving energy in vehicles, an automatic engine-stop system is adopted to many vehicles. For example, when a driver stops his vehicle at an intersection when the stop lamp (red or yellow lamp) of a traffic signal is lighting, the automatic engine-stop system mounted on the vehicle controls so that the vehicle is automatically fallen into the idling stop condition. As a result, the engine of the vehicle halts temporary for saving the fuel consumption. A silent engine start of the vehicle is very necessary for the driver when the engine of the vehicle restarts when the green or blue lamp of the traffic signal.

For example, Japanese patent laid open publication No. H5-126018 as a conventional technique has disclosed an electromagnetic switch mounted on a starter which is capable of starting an engine mounted on the vehicle. In the electromagnetic switch, a current flow through a magnetic coil enables to magnetize a stationary iron core, and thereby to form an electromagnet. The magnetic force of the electromagnet attracts and holds a plunger as a movable iron core. The electromagnetic attraction to the plunger closes a main contact of an energized electric circuit mounted on a starter motor for the engine of the vehicle.

However, a conventional electromagnetic switch causes a large impact noise or a large crashing sound when the plunger is attracted to and collides with the stationary iron core by the energized electromagnet. This impact noise becomes an obstacle to perform the silent engine start. In particular, because a vehicle capable of performing the idling stop frequently restarts, it is necessary to reduce operation noise of the electromagnetic switch in order to achieve the silent engine start, where the operation noise of the electromagnetic switch is an impact noise generated when the plunger is attracted to and collides with the stationary iron core.

SUMMARY OF THE INVENTION

It is an object of the present invention to provide an improved electromagnetic switch capable of suppressing propagation of loud crashing sound and of reducing operation noise generated when a plunger (as a movable iron core) is attracted to and then collides with a stationary iron core.

To achieve the above purposes, the present invention provides an electromagnetic switch configured to control open/close of an electric contact. The electromagnet switch has a magnet coil, a movable iron core, and a stationary iron core. The movable iron core is configured to move to the electric contact in order to electrically contact with the electric contact. The stationary iron core is configured to attract the movable iron core when magnetized by supplying a current through the magnet coil. In particular, the stationary iron core has a base part and a disk part. The base part is faced in arrangement to the movable iron core. The disk part of a cylindrical shape plate is assembled to the base part and placed at one side of the magnet coil. The disk part has a metal plate of ferromagnetic substance, and another substance plate having one of a spring constant smaller than that of the metal plate and a damping (or an attenuation) coefficient larger than that of the metal plate. The metal plate and another substance plate are laminated.

According to the present invention, because the disk part is composed of the metal plate and another substance plate having a smaller spring constant than that of the metal plate, the disk part absorbs an impact force when the movable iron core such as a plunger is attracted to the energized electromagnet and then collides with the stationary iron core. Furthermore, because the disk part is composed of the metal plate and another substance plate having a larger damping coefficient than that of the metal plate, the disk part enables to reduce operation noise such as impact noise or crashing sound when the movable iron core such as a plunger is attracted to the energized electromagnet and then collides with the stationary iron core.

According to another aspect of the present invention, an electromagnetic switch configured to control open/close of an electric contact has a magnet coil, a movable iron core, and a stationary iron core. The movable iron core is configured to move to and electrically contacted with the electric contact. The stationary iron core is configured to attract the movable iron core when magnetized by supplying a current to the magnet coil. The stationary iron core is composed mainly of a base part and a disk part. The base part is faced in arrangement to the movable iron core. The disk part of a cylindrical shape plate is assembled to the base part and placed at one side of the magnet coil. The disk part is composed of a plurality of metal plates of ferromagnetic substance laminated, and at least one of the metal plates having one of a smaller spring constant, a larger damping coefficient, and a smaller coefficient of friction than those of the other metal plates. In particular, at least a slit or a hole is formed in at least one of a plurality of the metal plates in order to reduce a spring constant or a damping coefficient of the disk part. According to the present invention, because the slit or hole is formed in at least one metal plate in order to reduce the spring constant of the disk part, it is possible to absorb impact force when the movable iron core is attracted to the energized electromagnet and then collides with the stationary iron core. Furthermore, because the slit or hole is formed in at least one metal plate in order to increase the damping coefficient of the disk part, it is possible to damp or attenuate the magnitude of the impact force when the movable iron core is attracted to the energized electromagnet and then collides with the stationary iron core. As a result, it is possible to reduce the operation noise of the electromagnet switch when the movable iron core collides with the stationary iron core.

In the electromagnetic switch according to another aspect of the present invention, one end of the slit or one end of the hole does not reach the outer periphery of the disk plate and is formed within an outer diameter of the metal plate. If the slit or the hole reaches the outer periphery of the metal plate, it becomes impossible to keep the sealing of the stationary iron core. It is possible to reduce the operation noise of the electromagnet switch while keeping the sealing of the stationary iron core when the slit or the hole is formed within the inside area of the disk plate which is smaller than the diameter of the metal plate, namely, the slit or the hole does not reach the outer periphery of the metal plate.

In the electromagnetic switch according to another aspect of the present invention, the slit or the hole is formed in each metal plate, and the slit or the hole formed in all of the metal plates laminated makes a penetrating hole in its lamination direction, and end terminals of the magnet coil are elongated toward an opposition direction to the position of the disk part through the penetrating hole. According to the above configuration, the penetrating hole is formed using the slit or the hole formed in each metal plate and the end terminals of the magnet coil are elongated through the penetrating hole toward the opposition direction of the disk part. This configuration does not require any additional penetrating hole for use in the elongation of the end terminals of the magnet coil and enables to enhance the magnetic characteristic of the stationary iron core.

In the electromagnetic switch according to another aspect of the present invention, a pair of penetrating holes is formed in symmetry of the diameter of the disk part. This configuration enables to commonly use the metal plates, and it is thereby possible to reduce the manufacturing cost of the electromagnetic switch.

In the electromagnetic switch according to another aspect of the present invention, a plurality of the metal plates in the disk part are laminated to each other regardless of a front surface and a back surface of each metal plate. This configuration enables to commonly use the metal plates regardless of the front and back surfaces, and it is thereby possible to reduce the manufacturing cost of the electromagnetic switch.

In the electromagnetic switch according to another aspect of the present invention, the disk part is composed of a plurality of metal plates of ferromagnetic substance which are laminated, and a surface treatment or a lubrication treatment is performed on the surface of at least one metal plate in order to have a smaller coefficient of friction rather than the other metal plates. According to this configuration of the electromagnet switch, because it is possible to reduce the coefficient of friction of the surface of the metal plate by performing the surface treatment or the lubrication treatment and thereby to reduce the friction between the metal plates laminated, the metal plates forming the disk part become flexible when the movable iron core collides with the stationary iron core. As a result, this configuration enhances the impact absorption (or damping) capability of the stationary iron core, and reduces the impact noise or crashing sound when the movable iron core is attracted to the energized electromagnet and then collides with the stationary iron core.

According to another aspect of the present invention, an electromagnetic switch is configured to control open/close of an electric contact. The electromagnet switch has a magnet coil, a movable iron core, and a stationary iron core. The movable iron core is configured to move to and electrically contacted with the electric contact. The stationary iron core is configured to attract the movable iron core when magnetized by supplying a current to the magnet coil. The stationary iron core has a base part and a disk part. The base part is faced in arrangement to the movable iron core and has a plurality of metal plates of ferromagnetic substance which are laminated. The disk part of a cylindrical shape plate is assembled to the base part and placed at one side of the magnet coil. Because this configuration enables to attenuate the impact force, generated when the movable iron core is attracted to the electromagnet and collides with the stationary iron core, by steps by the plural metal plates, it is possible to reduce the operation noise of the movable iron core when the movable iron core and the stationary iron core collide together.

In the electromagnetic switch according to another aspect of the present invention, a slit or a hole which penetrates toward the lamination direction is formed in at least one metal plate in order to reduce its spring constant or to increase its damping (or its attenuation) coefficient rather than that of the other metal plates. Because the slit or the hole is formed in at least one metal plate in order to have a small spring constant or a larger damping (or a larger attenuation) coefficient, it is possible to reduce the impact force when the movable iron core is attracted by the energized electromagnet and collides with the base part in the stationary iron core, and thereby to reduce the crashing sound when the movable iron core collides with the stationary iron core.

In the electromagnetic switch according to another aspect of the present invention, a surface treatment or a lubrication treatment is performed on the surface of at least one metal plate in order to have a smaller coefficient of friction than the coefficient of friction of other metal plates. Because the surface treatment or the lubrication treatment for the surface of the metal plate can reduce the coefficient of friction of the surface of the metal plate and reduces the friction between the surfaces of the laminated metal plates faced to each other, the metal plates become flexibility when the impact force is applied to the base part, for example, when the movable iron core collides with the stationary iron core. As a result, this configuration increases the impact absorption (or damping) capability of the stationary iron core and reduces the impact noise or crashing sound when the movable iron core collides with the stationary iron core.

In the electromagnetic switch according to another aspect of the present invention, the base part is composed of the metal plate of ferromagnetic substance and another substance plate having one of a smaller spring constant and a larger damping coefficient than that of the metal plate, and the metal plate and the another substance plate are laminated. Because the base part is composed of the combination of the metal plate and another substrate plate of a smaller spring constant or a larger damping (or attenuation) coefficient rather than that of the metal plate, another substrate plate can absorb the impact force when the movable iron core is attracted to the energized electromagnet and collides with the stationary iron core, namely, with the base part thereof, and it is thereby possible to reduce the operation noise of the electromagnet switch.

In the electromagnetic switch according to another aspect of the present invention, the base part comprises a plurality of metal plates of ferromagnetic substance which are laminated. This configuration further enables to reduce the operation noise of the electromagnet switch when the movable iron core collides with the stationary iron core by both of the impact absorption effects (or the damping effects) by the disk part and the base part.

In the electromagnetic switch according to another aspect of the present invention, the metal plates forming the disk part are fixed to each other. It is thereby possible to improve the manufacturing productivity of the electromagnet switch because the disk part and the base part which have the above described features can be combined in order to make the stationary iron core.

In the electromagnetic switch according to another aspect of the present invention, the metal plates forming the base part are fixed to each other. It is thereby possible to improve the manufacturing productivity of the electromagnet switch because the stationary iron core can be made by easily combining the disk part and the base part.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
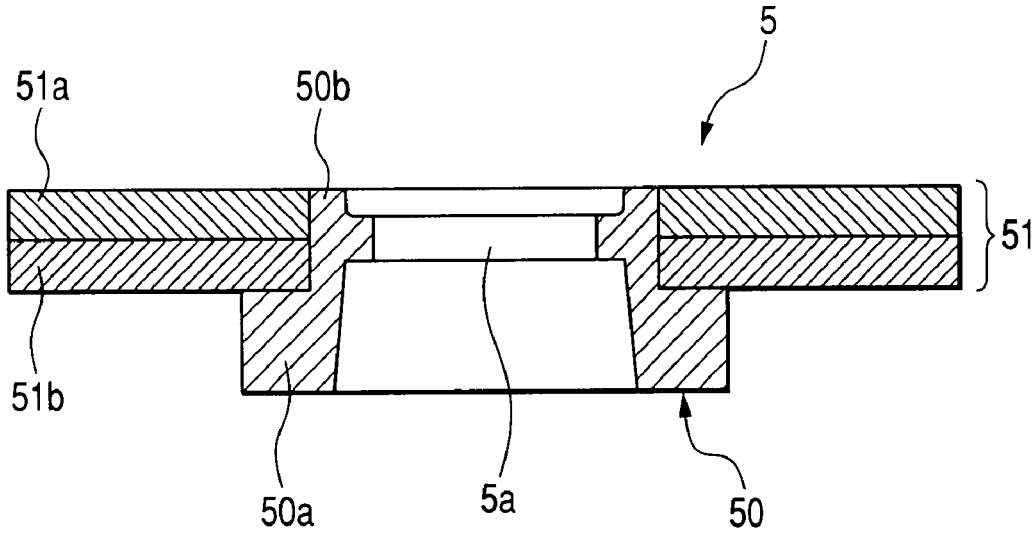
FIG. 1 is a sectional view showing a configuration of a stationary iron core of an electromagnetic switch according to a first embodiment of the present invention.

Hereinafter, various embodiments of the present invention will be described with reference to the accompanying drawings. In the following description of the various embodiments, like reference characters or numerals designate like or equivalent component parts throughout the several diagrams.

First Embodiment

A description will be given of the electromagnetic switch according to the first embodiment of the present invention with reference to FIG. 1 to FIG. 4.

Figure 2:
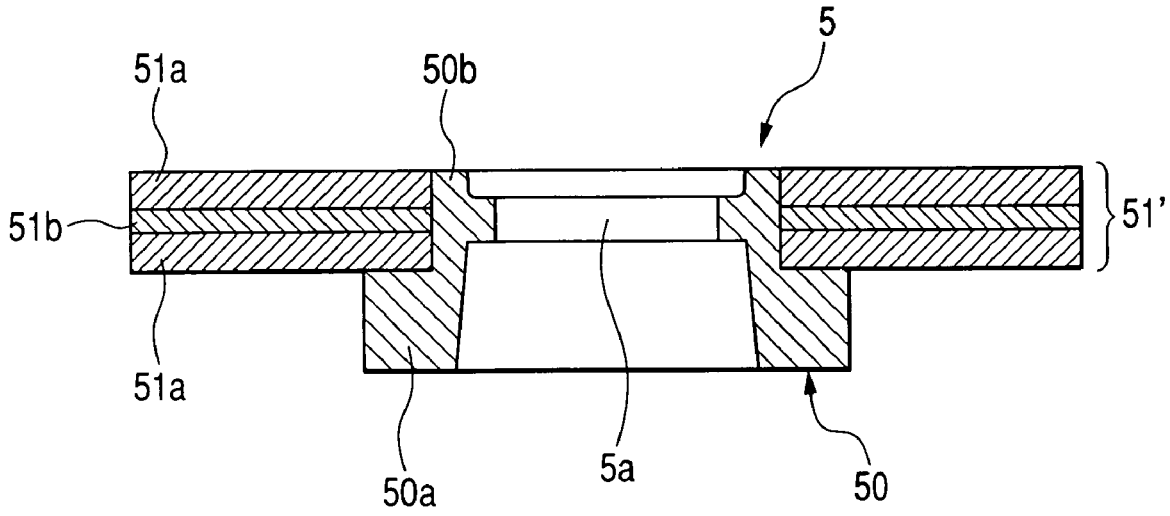
FIG. 2 is a sectional view showing another configuration of the stationary iron core of the electromagnetic switch according to the first embodiment.
Figure 3:
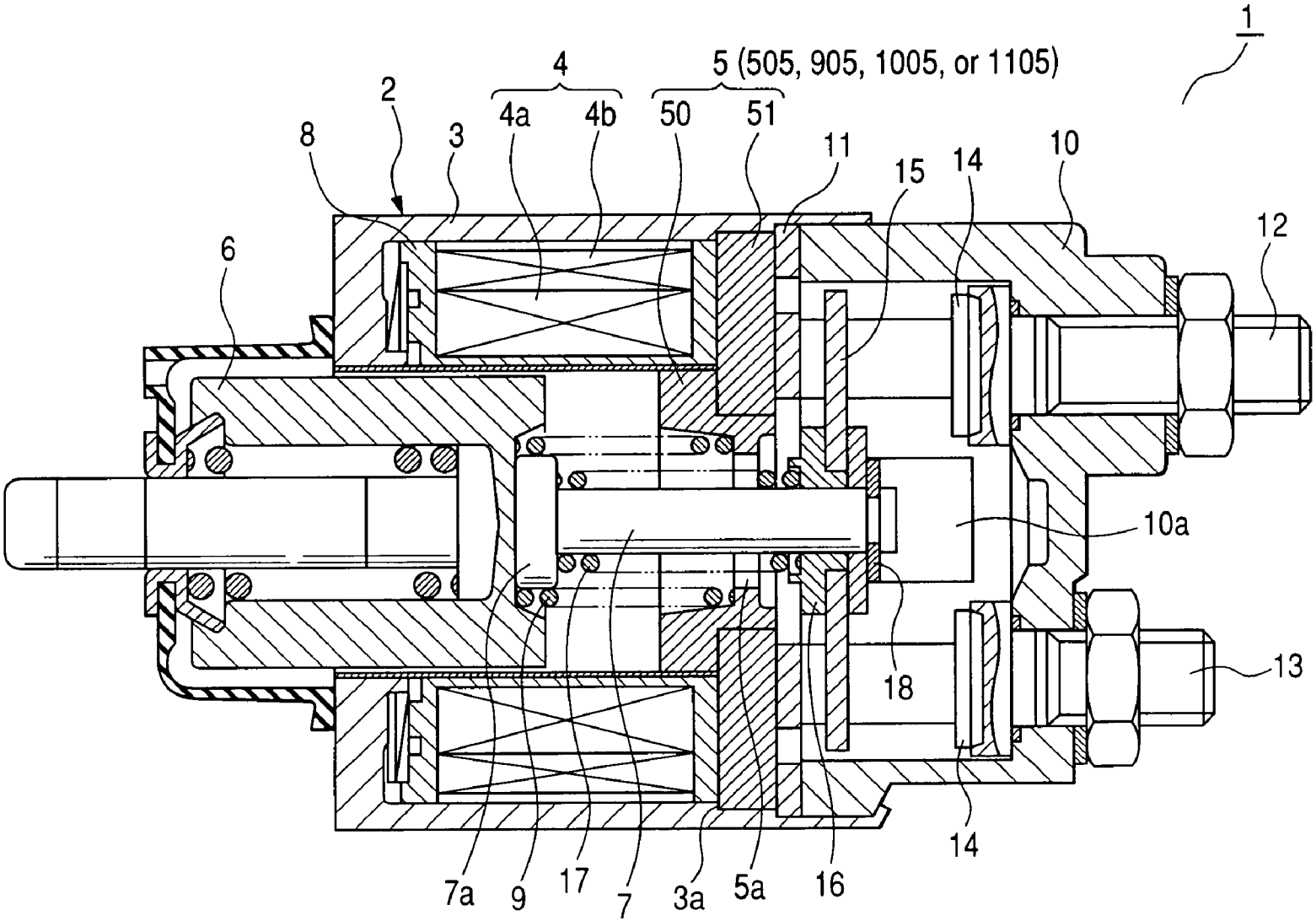
FIG. 3 is a sectional view showing an entire configuration of the electromagnetic switch according to the first embodiment of the present invention.

FIG. 1 is a sectional view showing a configuration of a stationary iron core 5 of the electromagnetic switch 1 according to the first embodiment of the present invention. FIG. 2 is a sectional view showing another configuration of the stationary iron core 5 of the electromagnetic switch 1 according to the first embodiment. FIG. 3 is a sectional view showing an entire configuration of the electromagnetic switch 1 according to the first embodiment.

The electromagnetic switch 1 according to the first embodiment is applied to a starter (not shown) mounted on a vehicle, for example. The starter is capable of starting an internal combustion engine mounted on the vehicle. As shown in FIG. 3, the electromagnetic switch 1 has a solenoid 2 forming an electromagnet by which a main contact, described later in detail, mounted on a motor electric circuit of the starter.

The solenoid 2 is composed mainly of a switch case 3 forming a yoke, a magnet coil 4 placed in the switch case 3, a stationary iron core 5 magnetized by energizing the magnet coil 4, a plunger 6 (as a movable iron core), and a movable shaft 7 with the plunger 6.

The magnet coil 4 is composed mainly of a magnetic attraction coil 4*a* and a magnetic hold coil 4*b*. The magnet attraction coil 4*a* generates the magnetic force for attracting the plunger 6. The hold coil 4*b* generates the magnetic force for holding the attracted plunger 6. Those coils 4*a* and 4*b* are wound in double layer structure on a bobbin 8 which is made of resin.

The stationary iron core 5 is composed mainly of a base part 50 and a disk part 51 forming a magnetic circuit around the magnetic coil 4 together with the switch case 3 and the plunger 6. The stationary iron core 5 will be explained later in detail.

The plunger 6 is faced in arrangement to the base part 50 of the stationary iron core 5 at the inner circumferential part of the magnet coil 4. The plunger 6 is forcedly pushed toward the opposite direction (in the left direction in FIG. 3) to the base part 50 by a return spring 9 placed between the base part 50 and the plunger 6.

A flange part 7*a* is formed at an end part of the shaft 7 and fixed to the end surface of the plunger 6 by welding so as to move it with the plunger 6 together.

The other end part of the shaft 7 is inserted into an electric contact room 10*a*, formed at the inside of the switch cover 10, through a center hole 5*a* formed in the base part 50 of the stationary iron core 5.

The switch cover 10 is for example made of resin and contacted to the disk part 51 of the stationary iron core 5 through a rubber packing 11 made of rubber, and fixed to the end part of the switch case 3 by caulking.

The main electric contact is composed of a pair of fixed contacts 14 and a movable contact 15. This movable contact 15 performs on/off operation between a pair of the fixed contacts 14. Both of the fixed contacts 14 are connected to the motor electric circuit through external terminals 12 and 13 which are fixed to the switch cover 10.

The movable contact 15 is mounted on the end part of the shaft 7 inserted in the contact room 10*a* through an insulation member 16, and forcedly pressed toward the front part (toward the right direction in FIG. 3) of the shaft 7 by a contact pressing spring 17 placed between the flange part 7*a* and the insulation member 16. The movable contact 15 is clamped by a washer 18 mounted on the front part of the shaft 7.

Figure 4:
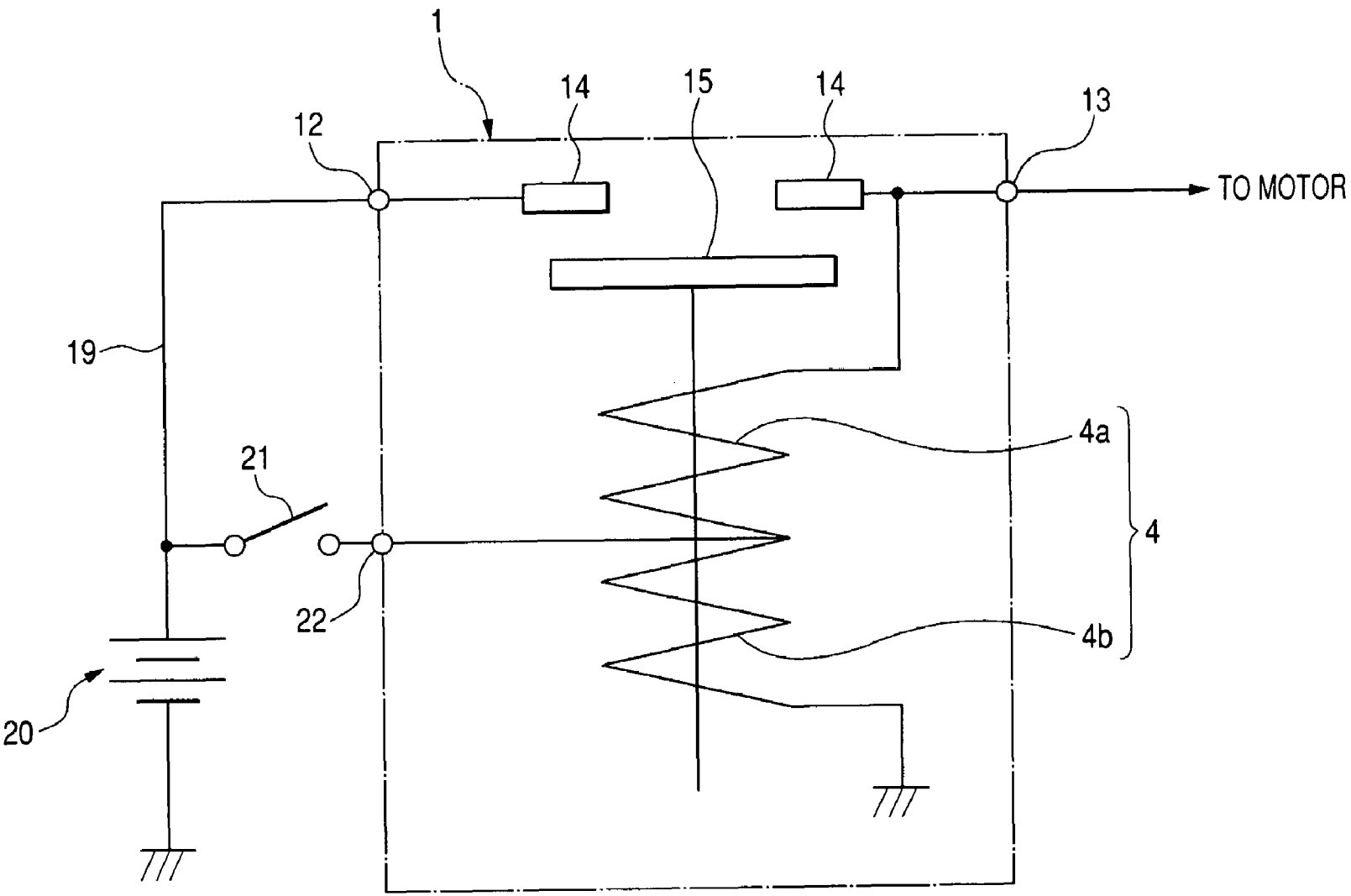
FIG. 4 is a view showing an electrical circuit in the electromagnetic switch according to the first embodiment.

As shown in FIG. 4, both of the external terminals 12 and 13 are B terminal (battery terminal) 12 and M terminal (motor terminal) 13. B terminal is electrically connected to a vehicle battery mounted on a vehicle through a battery cable 19 and M terminal 13 is electrically connected to a lead wire (omitted from drawings) of a motor.

A description will now be given of the configuration of the stationary iron core 5 with reference to FIG. 1 and FIG. 2.

The stationary iron core 5 is composed mainly of the base part 50 and the disk part 51. The base part 50 is faced to the plunger 6 and the disk part 51 is placed at one side of the magnetic coil 4 shown in FIG. 3. The outer diameter part of the disk part 51 is fit to a part 3*a* of a difference in level formed in the inner periphery of the switch case 3 shown in FIG. 3.

The base part 50 is a ring shaped body. A center hole 5*a* is formed at the center of the base part 50. The base part 50 is composed of a main body 50*a* and a cylindrical shaped boss part 50*b*. The main body 50*a* is fitted into the inner periphery of the magnet coil 4 and the cylindrical shaped boss part 50*b* projects toward the opposite direction of the plunger 6. The main body 50*a* and the cylindrical shaped boss part 50*b* are assembled in one body.

The disk part 51, as shown in FIG. 1, is composed of a metal plate 51*a* and a different material plate (or another material plate) 51*b*. The metal plate 51*a* is made of ferromagnetic substance such as an iron plate. The different material plate 51*b* is made of another material different from the metal plate 51*a*. For example, the different material plate 51*b* is made of one of resin, rubber, and the like having a smaller spring constant or a larger damping coefficient (or a larger attenuation coefficient) than those of the metal plate 51*a*. The metal plate 51*a* and the different material plate 51*b* are laminated.

Each of the metal plate 51*a* and the different material plate 51*b* has a ring shaped hole formed at a center part in its diameter direction thereof. The boss part 50*b* of the base part 50 is forcedly inserted into both of the ring shaped holes. Under this condition, the boss part 50*b*, the metal plate 51*a* and the different material plate 51*b* are integrated in one body. Although the disk part 51 shown in FIG. 1 is made in lamination configuration of the metal plate 51*a* and the different material plate 51*b*, it is acceptable to have a configuration in which the different material plate 51*b* is placed between a pair of the metal plates 51*a* in the disk part 51' shown in FIG. 2.

Next, a description will now be given of the operation of the electromagnetic switch 1. FIG. 4 is a view showing an electrical circuit in the electromagnetic switch 1 according to the first embodiment.

As shown in FIG. 4, when an ignition switch 21 is turned on, current flows through the magnetic coil 4, and the electromagnet is energized and the stationary iron core 5 is thereby magnetized. Because the plunger 6 is attracted toward the base part 50 of the stationary iron core 5, the plunger 6 moves toward the base part 50 (toward the right direction in FIG. 3) while pressing the return spring 9. The shaft 7 fixed to the plunger 6 is pushed out and the movable electric contact 15 supported by the end part of the plunger 6 is electrically and forcedly contacted to a pair of the fixed contacts 14. The plunger 6 further moves toward the base part 50 and finally reaches to and electrically contacted to the end surface of the base part 50 while pressing the contact pressing spring 17. When contacted to the end surface of the base part 50, the plunger 6 stops. The pressing force of the contact pressing spring 17 is provided to the movable electric contact 15, and the movable electric contact 15 is thereby pressed to a pair of the fixed contacts 14. As a result, the main contact is turned on, namely, closed, and the electric power is thereby supplied from the battery 20 to the starter motor (not shown).

When the ignition switch 21 is turned off after the start of the engine of the vehicle, the supply of the electric power to the magnetic coil 4 is halted. Thereby, the electromagnet does not generate the attraction force and the plunger 6 is returned in the opposite direction to the base part 50, namely, toward the original position by the spring force of the return spring 9. The movable electric contact 15 is thereby separated from a pair of the fixed contact 14. The main contact is thereby open and the power supply to the starter motor is halted.

(Action and Effects of the Electromagnetic Switch of the First Embodiment)

The stationary iron core 5 in the electromagnetic switch 1 according to the first embodiment is composed mainly of the two parts, the base part 50 and the disk part 51. Further, the disk part 51 is composed of the metal plate 51*a* of ferromagnetic material and the different material plate 51*b* made of another material that is different in component from the metal plate 51*a*. In particular, the metal plate 51*a* and the different material plate 51*b* are formed in a lamination structure, and the different material plate 51*b* has a spring constant smaller than a spring constant of the metal plate 51*a* or has a damping (or an attenuation) coefficient rather than that of the metal plate 51*a*. Because the different material plate 51*b* absorbs the impact force generated when the plunger 6 is forcedly attracted to and collided with the base part 50 by the electromagnetic force of the energized electromagnet, the impulsive sound or crashing noise of the collision is reduced and the propagation of the crashing noise is suppressed.

Second Embodiment

A description will be given of the electromagnetic switch according to the second embodiment of the present invention with reference to FIG. 5 and FIGS. 6A and 6B.

Figure 5:
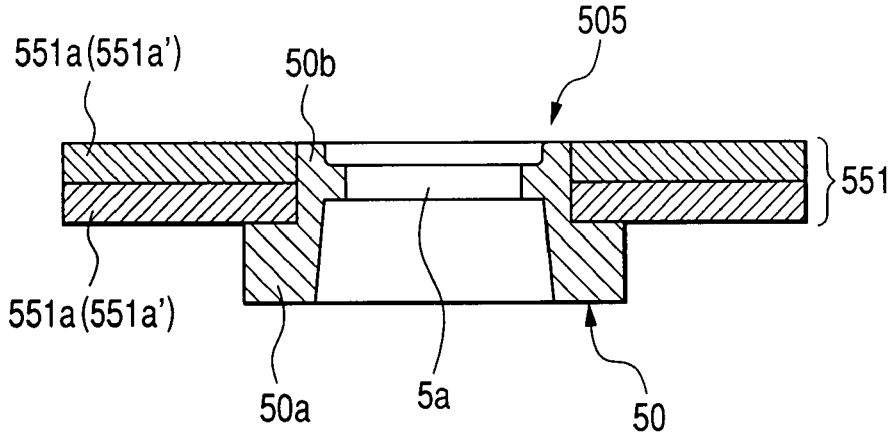
FIG. 5 is a sectional view showing a configuration of a stationary iron core of an electromagnetic switch according to a second embodiment of the present invention.

FIG. 5 is a sectional view showing a configuration of the stationary iron core 505 in the electromagnetic switch according to the second embodiment of the present invention.

Figure 6A:
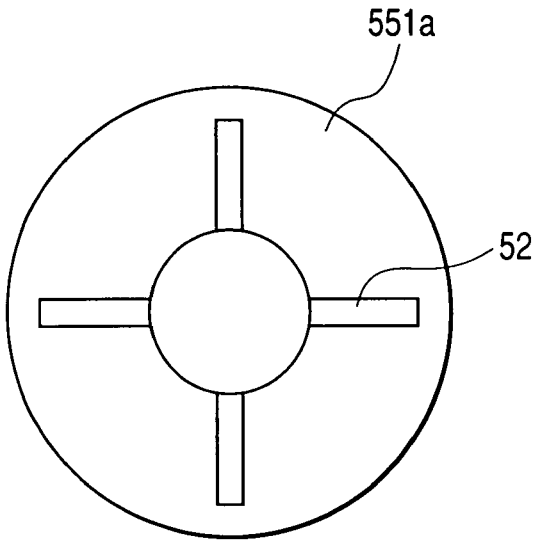
FIG. 6A is a plan view showing a configuration of a metal plate in which slits are formed.
Figure 6B:
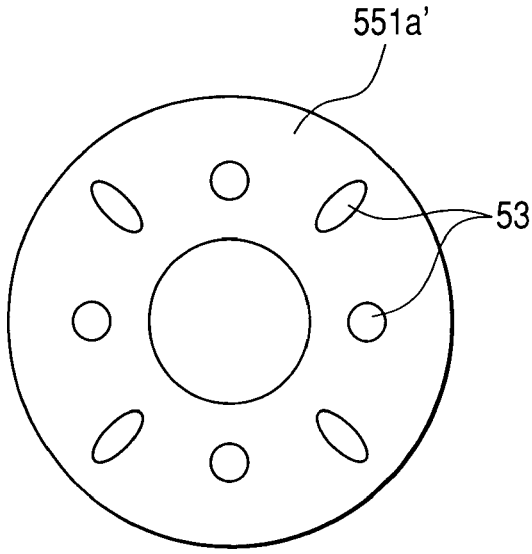
FIG. 6B is a plan view showing a configuration of a metal plate in which holes are formed.

FIG. 6A is a plan view showing a configuration of the metal plate 551*a* having slits 52, and FIG. 6B is a plan view showing a configuration of the metal plate 551*a'* having holes 53.

As shown in FIG. 5, the disk part 551 forming the stationary iron core 505 in the electromagnetic switch according to the second embodiment is composed of a plurality of metal plates (for example, iron plates) that are laminated. In the configuration shown FIG. 5, the stationary iron core 505 has a pair of the metal plates 551*a*. Further, at least one metal plate 551*a* has slits 52, as shown in FIG. 6A, or at least one metal plate 551*a'* has holes 53, as shown in FIG. 6B. The slits 52 and the holes 53 shown in FIG. 6A and FIG. 6B are formed in the metal plates 551*a* and 551*a'*. This configuration enables to reduce the spring constant thereof can be reduced or to increase the damping (attenuation) coefficient thereof.

As shown in FIG. 6A and FIG. 6B, the end part of each slit 52 (also each hole 53) formed in the diameter direction of the disk plate 505 does not reach the outer periphery of the metal plate 551*a* (551*a'*), and in other wards, is formed within the inside area of the metal plate 551*a* (551*a'*) which is smaller than the diameter of each disk plate 551*a* (551*a'*). Although the disk part 551 shown in FIG. 5 is composed of a pair of the metal plates 551*a* (551*a'*) laminated, it is of course acceptable to form the disk part 551 by three or more metal plates 551*a* (551*a'*) which are laminated.

In the second embodiment, it is possible to reduce the spring constant or to increase the damping (or the attenuation) coefficient by forming the slits 52 (or the holes 53) in at least one metal plate 551*a* (551*a'*). This configuration enables to reduce the impulsive sound or crashing noise of the collision and to suppress the propagation of the crashing noise when the plunger 6 is forcedly attracted to and collided with the base part 50 in the stationary iron core 505 by the electromagnetic force of the energized electromagnet.

If the slit 52 (or the hole 53) reaches to the outer periphery of the metal plate 551*a*(or 551*a'*), a rubber packing 11 made of rubber cannot fasten the stationary iron core 505, so that the stationary iron core 505 is not forcedly fixed to the switch cover 10 through the rubber packing 11. Such a case, it is difficult to seal the path from the outer periphery of the rubber packing 11 to the inside of the electromagnetic switch 1. In order to keep the sealing capability for the inside of the electromagnetic switch 1 to the outside, it is necessary to form the slit 52 (or the hole 53) within the inside area smaller than the diameter of the metal plate, as shown in FIG. 6*a* and FIG. 6B. That is, the slit 52 (or the hole 53) does not reach the outer periphery of the metal plates 551*a* and 551*a*'. This configuration of the metal plates 551*a* and 551*a*' enable to reduce the operation noise of the plunger 6 without deteriorating the sealing capability of the rubber packing 11.

Still furthermore, because the slits 552 and the holes 553 are formed at the inner periphery of the metal plates 551*a* and 551*a*' to be forcedly mated with or fit to the boss part 50*b* of the base portion 50, the metal plates 551*a* and 551*a*' are easily bent when the plunger 6 is forcedly attracted to and collided with the disk part 551 by the electromagnetic force of the energized electromagnet. Thus, this configuration of the stationary iron core 505 in the electromagnetic switch according to the second embodiment is capable of reducing the impulsive sound or crashing noise generated by the collision of the plunger 6 and of suppressing the propagation of the crashing noise.

Third Embodiment

A description will be given of the electromagnetic switch according to the third embodiment of the present invention with reference to FIG. 7 and FIG. 8.

Figure 7:
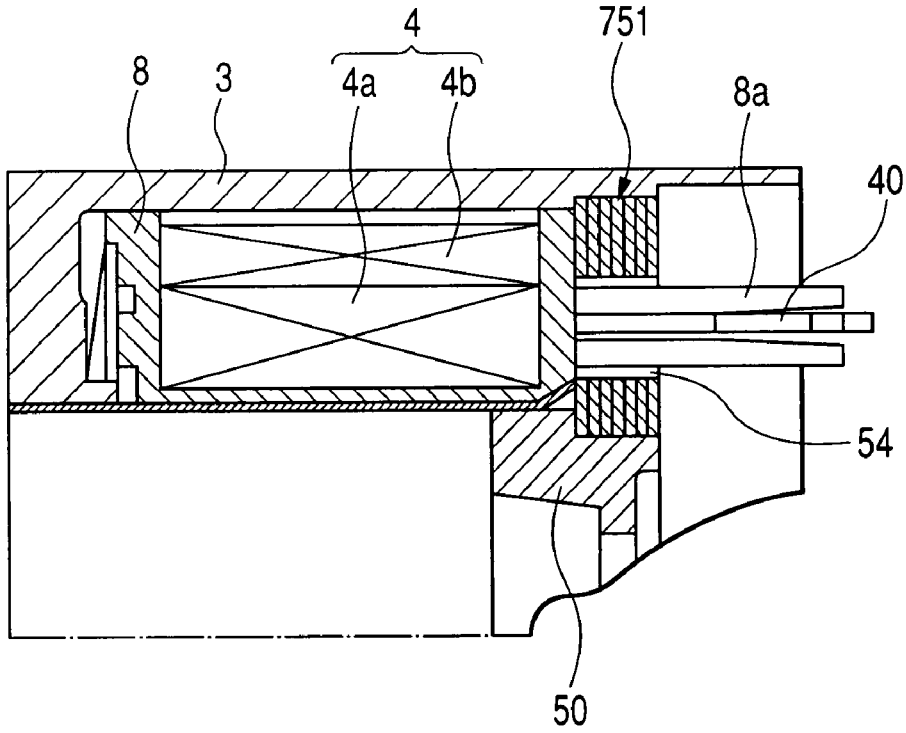
FIG. 7 is a partial view showing a configuration of an electromagnetic switch according to a third embodiment of the present invention.

FIG. 7 is a partial view showing a configuration of the electromagnetic switch according to the third embodiment of the present invention. FIG. 8 is a plan view showing a configuration of a disk part 751 forming the stationary iron core in the electromagnetic switch according to the third embodiment.

As shown in FIG. 7, each of the plural metal plates forming the disk part 751 of the stationary iron core has the slits 52 or the holes 53*s*, like the configuration of the second embodiment which has been explained with reference to FIGS. 6A and 6B. Further, a plurality of the plural metal plates 551*a* (see FIG. 6A) or 551*a*' (see FIG. 6B) are laminated and the plural silts 52 (or the holes 53) form penetrating holes which penetrate through the entire of the plural metal plates 551*a* (see FIG. 6A) or 551*a*' (see FIG. 6B). It is possible to form penetrating holes 54 having another configuration shown in FIG. 8. In this case, the penetrating holes 54 penetrate through all of the plural metal plates forming the disk part. Thus, it is acceptable to form various shapes of the penetrating hole in the disk part that forms the stationary iron core in the electromagnetic switch.

As shown in FIG. 7, the magnet coil 4 has an attracting coil 4*a* and a holding coil 4*b*. The attracting coil 4*a* attracts the plunger 6 when the attracting coil 4*a* is energized. The holding coil 4*b* holds the plunger 6 when the holding coil is energized. An end terminal 40 of each of the attracting coil 4*a* and the holding coil 4*b* is elongated in the reverse direction (toward the right direction in FIG. 7) to the disk part 751 through the penetrating hole 54 (see FIG. 8) and a support part 8*a*. This support part 8*a* is assembled with a bobbin 8 in one body.

As shown in FIG. 4, the end terminal of the attracting coil 4*a* in the magnet coil 4 is electrically connected to M terminal 13 and the other end terminal thereof is electrically connected to an ignition ON terminal 22 (also called to as "C terminal" or "50 terminal"). Further, an end terminal of the holding coil 4*b* is electrically connected to the 50-terminal (also referred to as "ignition-ON terminal" or "C terminal") and also connected to the other terminal of the attracting coil 4*a*. The other end terminal of the holding coil 4*b* is earthed to the surface of the disk part 751. Such 50-terminal (or "ignition-ON terminal" or "C terminal" is electrically connected to a lead wire mounted on the switch cover 10 and connected to the ignition switch 21, for example.

Figure 8:
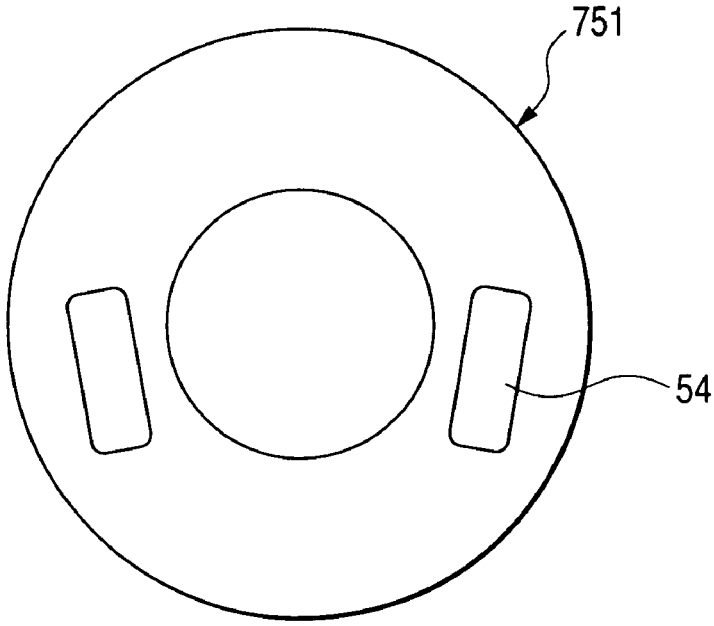
FIG. 8 is a plan view showing a configuration of a disk part in the electromagnetic switch according to the third embodiment of the present invention.

According to the electromagnet switch of the third embodiment, because the slits 52 or the holes 53 form the penetrating holes 54 in the disk part 751 and the presence of the slit 52 and the holes 53 reduces the spring constant and the damping (or the attenuation) coefficient of the entire of the disk part 751, it is not necessary to newly form penetrating holes to be used for the lead wires of the magnet coil 4 in addition to the slits 52 and the holes 53, and the configuration of the disk part 751 shown in FIG. 7 and FIG. 8 enables to suppress the deterioration of the magnetic characteristic.

As shown in FIG. 8, it is acceptable to form the two penetrating holes 54 through the disk part 751 in which the two penetrating holes 54 are formed in symmetry of line of the diameter of the disk part 751. It is also acceptable to laminate the plural metal plates regardless of a front surface and a back surface of each metal plate forming the disk part 751.

Still further, because the metal plates forming the disk parts 751 are commonly used when a pair of the penetrating holes 54 are formed in symmetry of line of the diameter of the disk part 751 and the plural metal plates are laminated regardless of the front and back surfaces of each metal plate, it is possible to reduce the working cost and thereby to reduce the manufacturing cost of the electromagnetic switch.

Fourth Embodiment

A description will be given of the electromagnetic switch according to the fourth embodiment of the present invention with reference to FIG. 9.

Figure 9:
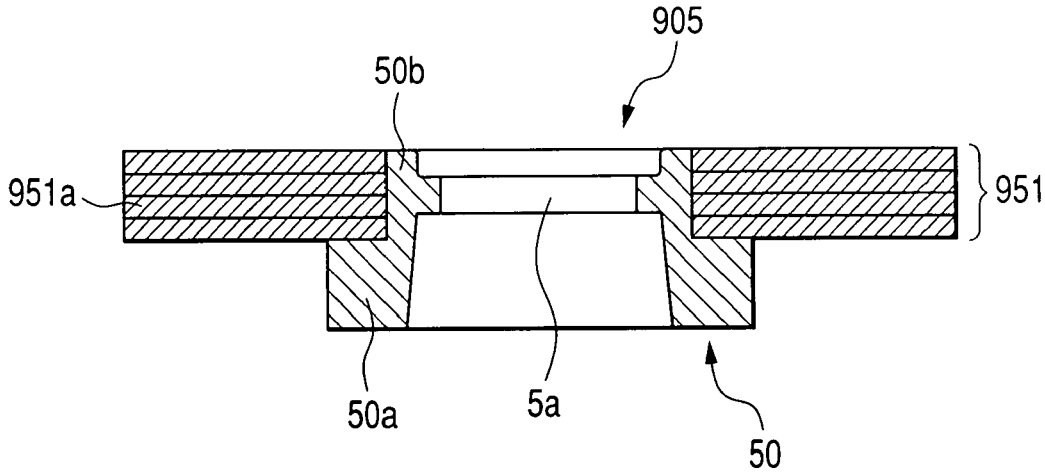
FIG. 9 is a sectional view showing a configuration of a stationary iron core of an electromagnetic switch according to a fourth embodiment of the present invention.

FIG. 9 is a sectional view showing a configuration of the stationary iron core 905 in the electromagnetic switch according to the fourth embodiment of the present invention.

As shown in FIG. 9, the disk part 951 forming the stationary iron core 905 in the electromagnet switch is composed of a plurality of metal plates 951*a* of ferromagnetic material such as iron plates which are laminated. Further, the surfaces of each of the metal plates 951*a* are given by surface treatment or lubrication treatment. For example, grease is applied onto one or both of the surfaces of each metal plate 951*a* in order to reduce the coefficient of friction between the surfaces of the metal plates 951*a*. Using the disk part 951 of a lamination structure in which the plural metal plates 951*a* are laminated enables to reduce a spring constant of the entire disk part 951 even if the total thickness of the disk part 951 is equal to the thickness of a disk part composed of only one metal plate because the spring constant of each of the laminated metal plates is in proportion to a cube of a ratio of the thickness of the disk part.

Further, because the surface treatment or the lubrication treatment on the surfaces of each metal plate 951*a* enables to reduce the friction between the metal plates 951*a* which are laminated and faced to each other, each metal plate 951*a* is easily and flexible when the plunger 6 and the stationary iron core 905 collide to each other. As a result, the flexibility of each metal plate 951*a* further reduces the spring constant of the disk part 951 in the stationary iron core 905, and enhances the impact absorption effect and thereby reduces the impact noise.

Fifth Embodiment

A description will be given of the electromagnetic switch according to the fifth embodiment of the present invention with reference to FIG. 10.

Figure 10:
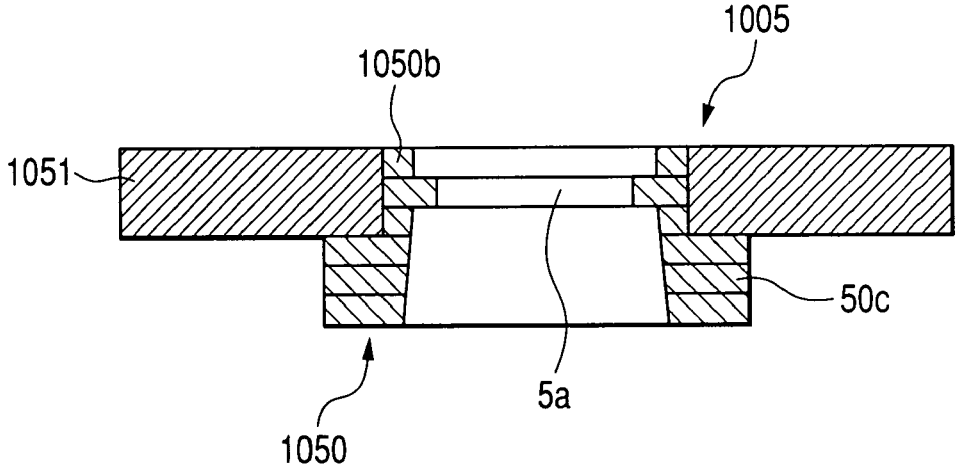
FIG. 10 is a sectional view showing a configuration of a stationary iron core of an electromagnetic switch according to a fifth embodiment of the present invention.

FIG. 10 is a sectional view showing a configuration of the stationary iron core 1005 of the electromagnetic switch according to the fifth embodiment of the present invention.

As shown in FIG. 10, a base part 1050 forming the stationary iron core 1005 is composed of a plurality of metal plates 50*c* of ferromagnetic material such as iron plates which are tightly laminated by caulking in the lamination direction of the metal plates 50*c* and fixed by welding.

On the other hand, the disk part 1051 is made of a single thick metal plate 1051 having a circular penetrating hole formed at the center of the metal plate. Through the circular penetrating hole, a boss part 1050*b* of the stationary iron core 1005 is forcedly inserted, and fixed to the base part 1050.

The stationary iron core 1005 in the electromagnet switch according to the fifth embodiment has the base part 1050 that is composed of a plurality of the metal plates 50*c* that are laminated. The plunger 6 is attracted to and collides with the base part 1050 when the electromagnet is energized. The plural metal plates 50*c* forming the base part 1050 in the lamination configuration absorbs the impact force generated between the plunger 6 and the base part 1050 in the stationary iron core 1005. This configuration enables to reduce the operation noise of the electromagnet switch when the plunger 6 collides with the stationary iron core 1005.

Sixth Embodiment

A description will be given of the electromagnetic switch according to the sixth embodiment of the present invention with reference to FIG. 11.

Figure 11:
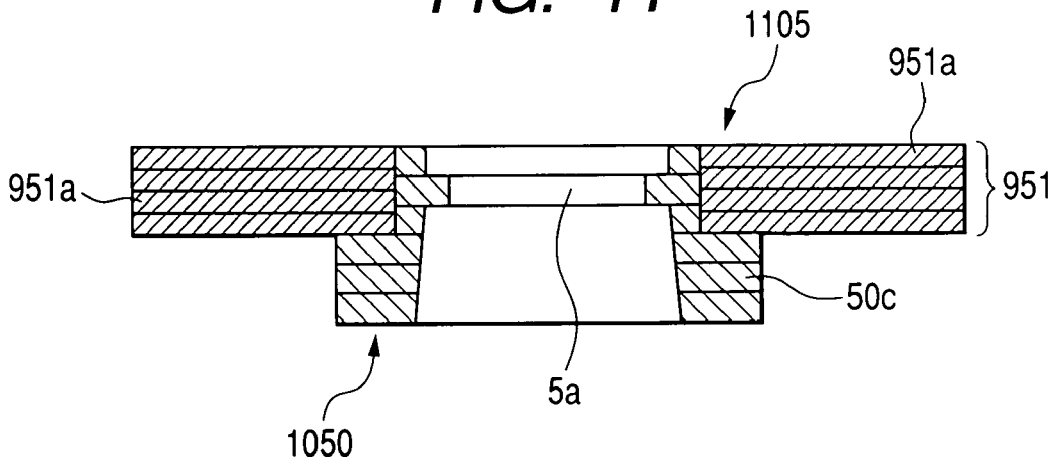
FIG. 11 is a sectional view showing a configuration of a stationary iron core of an electromagnetic switch according to a sixth embodiment of the present invention.

FIG. 11 is a sectional view showing a configuration of the stationary iron core 1105 of an electromagnetic switch according to a sixth embodiment of the present invention.

As shown in FIG. 11, the electromagnetic switch according to the sixth embodiment has the disk part 951 composed of a plurality of the metal plates 951*a* in a lamination configuration and the base part 1050 composed of a plurality of the metal plates 50*c* in lamination configuration.

This configuration of the stationary iron core 1105 in the electromagnetic switch according to the sixth embodiment enables to reduce the impact sound or crashing noise when the plunger 6 forcedly collides with the base part 1050 because the configuration of the electromagnet switch has the multiple effects, namely, the impact absorption effect obtained by the disk part 951 composed of the laminated plural metal plates 951*a* and the impact absorption effect obtained by the base part 1050 composed of the laminated plural metal plates 50*c*.

(Modification Example)

Figure 12:
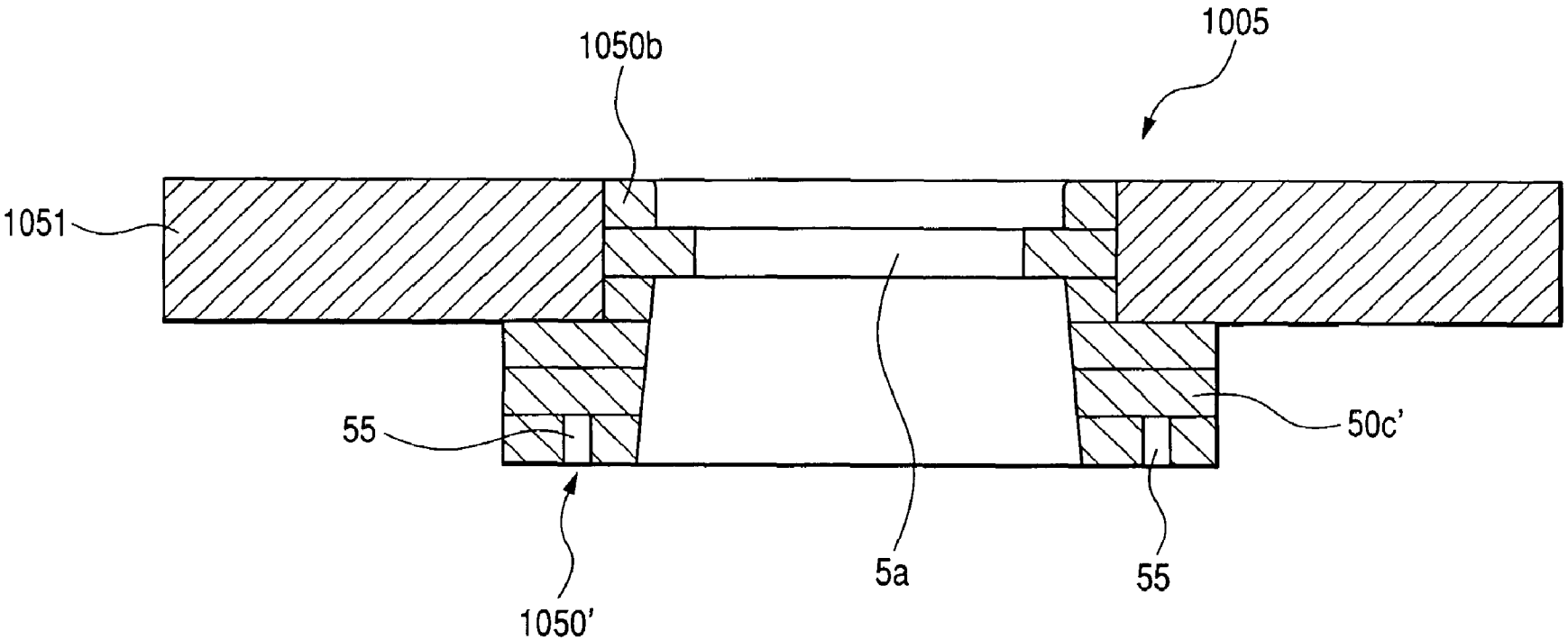
FIG. 12 is a sectional view showing another configuration of the stationary iron core of the electromagnetic switch according to a modification example.

In order to reduce the spring constant of the stationary iron core or to increase the damping (attenuation) coefficient of the stationary iron core, as shown in FIG. 12, it is acceptable to form the slit or the hole in at least one metal plate 50*c*' (the slit or the hole is designated by reference number 55 in FIG. 12) in the plural metal plates 50*c*' forming the base part 1050' in the electromagnetic switch according to a modification example in the fifth and sixth embodiments of the present invention.

Further, in order to reduce the coefficient of friction of the surfaces of the metal plate, it is possible to perform the surface treatment or lubrication treatment, for example, to apply grease onto one or both of the surfaces of at least one metal plate 50*c* forming the base part 1050 in the electromagnetic switch according to the fifth and sixth embodiments of the present invention.

Still further, it is acceptable to form the stationary iron core composed of the base part 1050 having the configuration of the fifth and sixth embodiments shown in FIG. 10 and FIG. 11 and the disk part having the configuration of the first to fourth embodiment shown in FIG. 1 to FIG. 8. In the configuration of the fifth and sixth embodiments, the base part is composed of the plural metal plates of ferromagnetic material such as an iron plate) which are laminated. The present invention is not limited by this configuration. For example, it is acceptable to form the base part by combining the metal plates of ferromagnetic substance and different substance plates having a smaller spring constant than that of the metal plates or having a larger damping coefficient than that of the metal plates. Furthermore, it is acceptable to form the stationary iron core by combining the above base part composed of the metal plates and the different substance plates and the disk part in the electromagnetic switch according to the first to fourth embodiments.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalent thereof.

What is claimed is:

1. An electromagnetic switch configured to control open/close of an electric contact, comprising:

a magnet coil;

a movable iron core movably contacted with the electric contact; and a stationary iron core configured to attract the movable iron core when magnetized by supplying a current to the magnet coil, the stationary iron core comprising:

a base part faced in arrangement to the movable iron core; and a disk part of a cylindrical shape plate assembled to the base part, placed at one side of the magnet coil, and the disk part comprising:

a metal plate of ferromagnetic substance; and another substance plate having one of (a) and (b):

(a) a spring constant which is smaller than that of the metal plate; and (b) a damping coefficient which is larger than that of the metal plate; and wherein the metal plate and another substance plate are laminated.

2. An electromagnetic switch configured to control open/close of an electric contact, comprising:

a magnet coil;

a movable iron core movably contacted with the electric contact; and a stationary iron core configured to attract the movable iron core when magnetized by supplying a current to the magnet coil, the stationary iron core comprising:

a base part faced in arrangement to the movable iron core; and a disk part of a cylindrical shape plate assembled to the base part and placed at one side of the magnet coil, and the disk part comprising a plurality of metal plates of ferromagnetic substance which are laminated, and at least one, but not all, of the metal plates having one of (a), (b), and (c):

(a) a spring constant, which is smaller than that of the other metal plates;

(b) a damping coefficient which is larger than that of the other metal plates; and (c) a coefficient of friction which is smaller than that of the other metal plates.

3. The electromagnetic switch according to claim 2, wherein at least a slit or a hole is formed in at least one of a plurality of the metal plates in order to reduce a spring constant or a damping coefficient of the disk part.

4. The electromagnetic switch according to claim 3, wherein one end of the slit or of the hole does not reach the outer periphery of the disk plate and formed within an outer diameter of the metal plate.

5. The electromagnetic switch according to claim 3, wherein the slit or the hole is formed in each metal plate, and the slit or the hole formed in all of the metal plates laminated make a penetrating hole in its lamination direction, and end terminals of the magnet coil are elongated toward an opposition direction to the disk part through the penetrating hole.

6. The electromagnetic switch according to claim 3, wherein the slit or the hole is formed in each metal plate, and the slit or the hole formed in all of the metal plates laminated make two penetrating holes in a lamination direction of the metal plates, and end terminals of the magnet coil are elongated toward an opposition direction to the disk part through the penetrating holes, and the two penetrating holes are formed in symmetry of the diameter of the disk part.

7. The electromagnetic switch according to claim 5, wherein a plurality of the metal plates in the disk part are laminated to each other regardless of a front surface and a back surface of each metal plate.

8. The electromagnetic switch according to claim 2, wherein the disk part is composed of a plurality of metal plates of ferromagnetic substance laminated, and a surface treatment or a lubrication treatment is performed on the surface of at least one metal plate in order to have a smaller coefficient of friction rather than the other metal plates.

9. An electromagnetic switch configured to control open/close of an electric contact, comprising:

a magnet coil;

a movable iron core movably contacted with the electric contact; and a stationary iron core configured to attract the movable iron core when magnetized by supplying a current to the magnet coil, the stationary iron core comprising:

a base part faced in arrangement to the movable iron core, and comprising a plurality of metal plates of ferromagnetic substance which are laminated; and a disk part of a cylindrical shape plate assembled to the base part and placed at one side of the magnet coil wherein the base part is composed of the metal plate of ferromagnetic substance and another substance plate which are laminated, and the another substance is a material having one of (a) and (b):

(a) a spring constant which is smaller than that of the metal plate; (b) a damping coefficient which is larger than that of the metal plate.

10. The electromagnetic switch according to claim 9, wherein a slit or a hole which penetrates toward the lamination direction is formed in at least one metal plate in order to reduce its spring constant or to increase its damping coefficient rather than that of the other metal plates.

11. The electromagnetic switch according to claim 9, wherein the surface of at least one metal plate is treated by either a surface treatment or a lubrication treatment in order to reduce its coefficient of friction.

12. The electromagnetic switch according to claim 1, wherein the base part comprises a plurality of metal plates of ferromagnetic substance which are laminated.

13. The electromagnetic switch according to claim 1, wherein the metal plates forming the disk part are fixed to each other.

14. The electromagnetic switch according to claim 9, wherein the metal plates forming the disk part are fixed to each other.

15. The electromagnetic switch according to claim 9, wherein the metal plates forming the base part are fixed to each other.

16. The electromagnetic switch according to claim 12, wherein the metal plates forming the base part are fixed to each other.

* * * * *